United States Patent [19]

Ruf et al.

[11] 3,961,461

[45] June 8, 1976

[54] BAG MACHINE

[75] Inventors: Walter Ruf, Spring Valley; Robert George Kelley, Central Valley, both of N.Y.

[73] Assignee: St. Regis Paper Company, New York, N.Y.

[22] Filed: Mar. 3, 1975

[21] Appl. No.: 554,663

[52] U.S. Cl. ..... 53/188; 53/384

[51] Int. Cl.[2] ..... B65B 1/06; B65B 43/34

[58] Field of Search ..... 53/187, 188, 190, 191, 53/384, 386

[56] References Cited

UNITED STATES PATENTS

| | | | |
|---|---|---|---|
| 2,722,358 | 11/1955 | Wilson | 53/188 X |
| 2,833,097 | 5/1958 | Petrea et al. | 53/188 |
| 2,899,786 | 8/1959 | Harker | 53/187 |
| 3,323,280 | 6/1967 | Rausch | 53/188 |
| 3,465,499 | 9/1969 | Nelson et al. | 53/188 X |
| 3,498,020 | 3/1970 | Epenberger | 53/188 X |

*Primary Examiner*—Travis S. McGehee
*Assistant Examiner*—Horace M. Culver
*Attorney, Agent, or Firm*—Woodling, Krost, Granger & Rust

[57] ABSTRACT

A bag machine is disclosed wherein bags are supplied from a bag holder such as a bag magazine to a multi-station bag filler whereat they are filled and are then supplied to a bag closer which closes and seals the filled bag. The multi-station bag filler is shown with four stations with bags being supplied to a bag pickup station therein from the bag closer. The bag filler includes a frame rotating on a base with gripper hands carried on arm means. The gripper hands grip face-to-face over the two top corners of a bag in the pickup station. A motor is provided to index the frame into the four different stations with a second station being a bag opening station whereat the gripper hands move toward each other and move upwardly to move the opened bag up onto an openable spout. A third station is a bag-filling station whereat material is delivered from a hopper via the spout to the opened bag. The fourth station is a bag-discharge station to the closer-sealer. The foregoing abstract is merely a resume of one general application, is not a complete discussion of all principles of operation or applications, and is not to be construed as a limitation on the scope of the claimed subject matter.

15 Claims, 3 Drawing Figures

BAG MACHINE

BACKGROUND OF THE INVENTION

Many bag machines have been designed including many to fill bags. In many cases such bag filling machines have been slow and cumbersome in operation. In others it has been difficult to fill certain types of bags, especially multi-layer bags such as multiple layer paper bags of the pinch-bottom type. Such bags might have a length of 24–30 inches (63–76 cms.) and in the past they have been aligned at a bag opener and filler by orientating from the bottom of the bag. In many cases total length of the bag varies as much as 0.25 inches (0.635 cms.) and this has meant that the later sealing of the bag is often defective. Many such bags have an adhesive already applied on the inside face of the longer side of the bag which longer side is folded over and then the adhesive is activated to effect a seal. If too much or too little of the long side is folded over, the adhesive seal can be defective. Where finely powdered material or foodstuffs are being packaged, this can either leak out or vermin may creep in to thus be a defective bag.

In many of the prior art bag filling machines the bag could be orientated improperly and still the machine would attempt to fill the bag, thus achieving an improper seal when the bag was subsequently closed and sealed. Many of such prior art machines were also only a single station machine which was inherently slow in operation because first, the bag had to be put into position; second, it had to be opened; third, it often had to be raised to a filling position; fourth, it had to be filled; and fifth, it had to be moved on to a closing and sealing station. These many functions at one location resulted in a slow and cumbersome machine. Accordingly, an object of the present invention is to obviate the many disadvantages of the prior art machines.

The problem to be solved is to achieve a rapid acting and positive bag filling machine.

Another object of the invention is to provide a multiple station bag filling machine whereat the separate functions of the picking up of the bag, opening the bag, and filling the bag may be accomplished at different physical stations.

Another object of the invention is to provide a bag filling machine whereat the bags are properly orientated before they are opened.

Another object of the invention is to provide a bag filling machine whereat improperly orientated bags are rejected and the bags are properly oriented before they are attempted to be opened and filled.

DESCRIPTION OF THE PREFERRED EMBODIMENT

Figure 1:
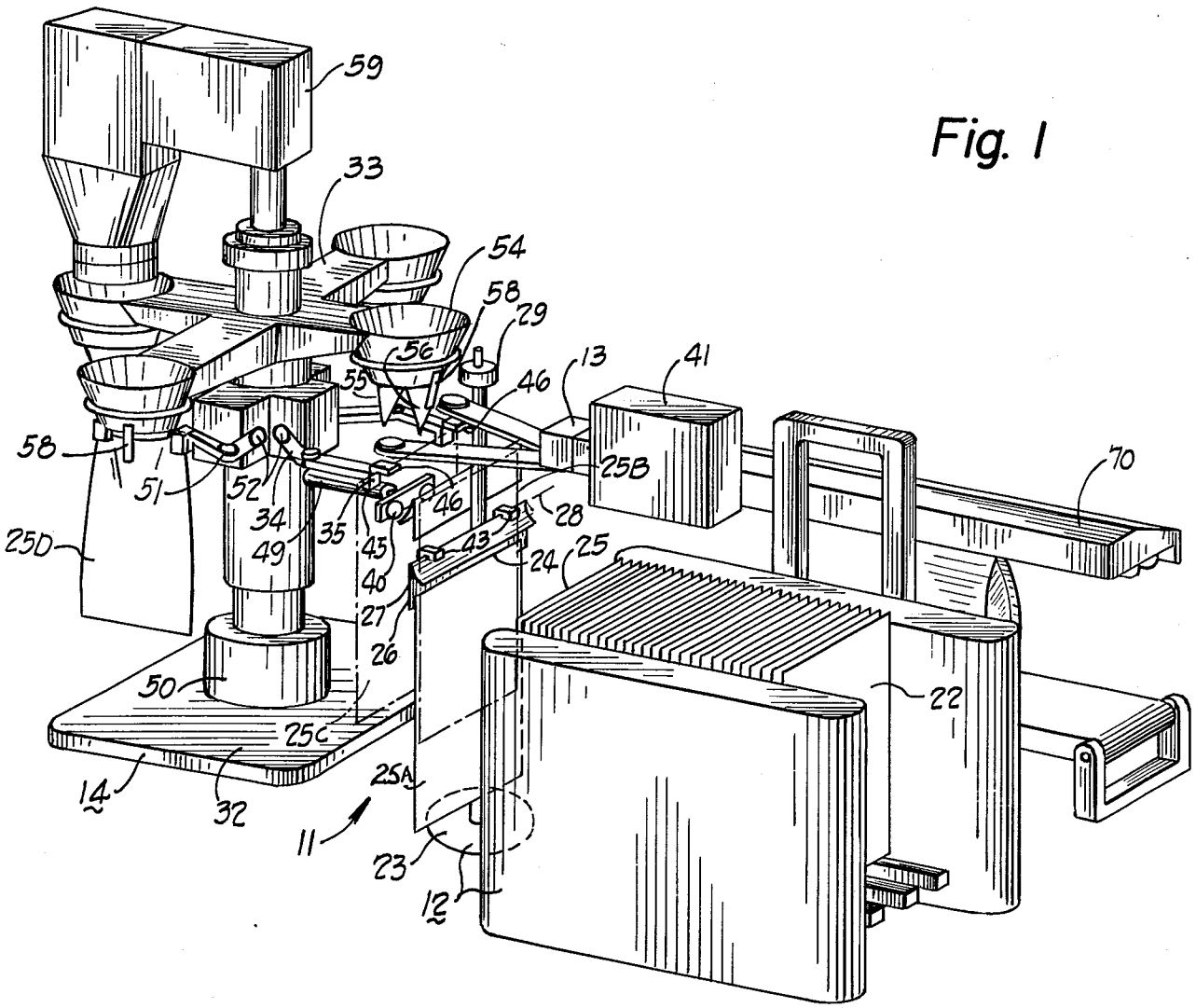
FIG. 1 is a perspective frontal view of a bag filling machine embodying the invention.

The figures of the drawing illustrate a bag machine 11 which incorporates a preferred embodiment of the invention and which includes generally three parts: a bag holder 12, a bag closer 13, and a multi-station bag filler 14. The bag holder 12 supplies bags to a bag pickup station 17 of the bag filler 14, see FIG. 3. This multi-station bag filler has at least two stations, the bag pickup station 17 and a bag filling station 19. Preferably, it also has a bag opening station 18 and a bag discharge station 20 to the bag closer 13. The bag closer 13 preferably includes a sealer so that the filled bags are not only closed but adhesively sealed.

The bag holder 12 may include most any convenient means to supply bags to the bag pickup station 17. As shown, the preferred embodiment includes in the bag holder 12 a bag magazine 22 and an aligner-feeder 23. The bags in the bag magazine 22 may be bags of the pinch-bottom type such as multi-layered paper bags. The top edge 24 of the bag is the opening of the bag and a forward one 25 of the bags in the magazine is the bag which is transmitted to the aligner-feeder 23 and is shown in FIG. 1 as a bag 25A in horizontal alignment with the bags in the magazine yet vertically aligned with an alignment member 26. The aligner-feeder 23 then moves this bag 25A vertically upwardly into an inverted V notch 27 and this aligns the top openable edge 24 along a horizontal locator axis 28. The aligner-feeder 23 has a motor 29 to rotate it about its base so that the bag 25A is turned 180° into a position 25B shown in phantom in FIG. 1. The aligner-feeder 23 has two such alignment members 26 and inverted V notches 27 so that the process may be repeated for the next bag. This aligner-feeder 23 is more fully described in the copending application entitled BAG ALIGNER MACHINE, filed Jan. 27, 1975, Ser. No. 544,020, and the subject matter of such patent application is incorporated herein by reference.

The multi-station bag filler 14 includes a base 32 with a frame 33 journalled thereon for rotation about a vertical axis. Arm means shown as four pairs of arms 34 are provided on the rotatable frame 33. A pair of gripper hands 35 are provided on the arm means and in this preferred embodiment there are four pairs of such gripper hands 35. The gripper hands 35 move in a first path between first and second positions. The first path is horizontal and the first position is one wherein the hands are spaced apart approximately the width of the bag 25. The second position of the hands is where they are closer together to help establish opening of the bag, as described below.

A transfer arm 38 is mounted for reciprocation in a horizontal plane relative to the base 32 and this transfer arm 38 has means to transfer the bag from the aligner-feeder to the pickup station 17. In the preferred embodiment this includes a bracket 39 mounted on the arm 38 with two suction cups 40 mounted on the bracket. The transfer arm has a retracted and an advanced position with the advanced position such that the suction cups 40 engage a bag in the position 25B shown in phantom. Suction is then applied to such suction cups by a control circuit 41 so that the bag is held by the transfer arm 38.

The aligner-feeder 23 includes two sensors 43 which are engaged by the top edge 24 of the bag when the bag is properly moved up into the inverted V notch 27 so that this top edge is at the locator-axis 28. If both sensors 43 are not actuated, this shows that the bag may be skewed or may be absent, and, hence, it is rejected by the control circuit 41. This rejection may take the form of merely dropping the bag to the floor or failing to actuate the suction on the suction cups 40 or some other similar means so that the bag is not transferred by the transfer arm 38 to the pickup station 17. By this manner properly aligned and orientated bags are accepted at the pickup station, yet misaligned bags, or bags not raised to the proper vertical level are rejected.

The gripper hands 35 have open and closed positions and are shown in the open position at the pickup station 17 of FIG. 1. With the transfer arm 38 in the advanced position, the suction cups 40 engage the bags 25 in the position 25B shown in phantom in FIG. 1. Assuming the bag is properly aligned and vertically positioned, then the control circuit 41 will permit movement of such bag by the transfer arm 38 to the pickup station 17. This is done by retracting the transfer arm 38 relative to the base 32. In such retracted position the bag would be in the phantom position 25C whereat it would abut the rear part 45 of the gripper hands 35. The forepart 46 of the gripper hands 35 would then close downwardy, by conventional means, to grip face-to-face over the two top corners of the bag 25.

A first motor 49 is connected to move the transfer arm 38 between retracted and advanced positions, as controlled by the control circuit 41. A second motor 50 is connected to act between the base 32 and the frame 33 to index the frame around the vertical axis. This indexing is to move this frame between the bag pickup station 17 and the bag filling station 19. As stated above, the preferred embodiment also includes a bag opening station 18 and a bag discharge station 20 so that the motor means 50 is connected to index this frame 33 90° between adjacent ones of the four different stations.

The frame 33 also includes four spouts 54 with openable clam-shell jaws 55 and 56, with the front jaw 56 slightly longer. These jaws are shown in the open position in the pickup station 17 of FIG. 1 and are shown also in the open position in the bag opening station 18 of FIG. 1. The rear side of the bag 25 is longer and extends upwardly higher than the front side of this bag.

With a bag held in the gripper hands 35 at the pickup station 17, then the second motor 50 indexes the frame 33 90°. The frame 33 has four pairs of arms 34, each with gripper hands so that another pair of gripper hands is now at the pickup station 17 ready to receive another bag. The spout jaws 55 and 56 are initially in an open position. The jaws close, by conventional means, during this indexing movement and the longer front jaw 56 engages the longer rear wall of the bag 25 to push it backward slightly to begin the opening of the bag. Next, the hands raise by raising the arms 34 at shoulder pivots 52 by conventional means, and as they raise, the closed jaws penetrate into the bag. The jaws in the closed position present a wedge shape which wedges itself into the bag, opening it still further. As the bag is raised, it is, therefore, opened and the gripper hands are drawn toward each other, resisted by spring means, not shown. By the time that the gripper hands have indexed from the 3 o'clock position to the 6 o'clock position of FIG. 3, the bag will be raised to its proper filling position. Alternatively, this bag opening movement may take place all at the bag opening station 18.

Sensors 58 are mounted as levers depending from the spouts 54 and one coacts with each jaw 55 and 56 in a position whereat when the bag is raised to proper position, these sensor levers 58 are actuated outwardly as the jaws open in the bag opening station 18. The proper actuation of these sensors 58 show that the bag is properly spouted. If the bag is not properly spouted, it is ejected, e.g., by opening of the gripper hands to drop the bag. In such case the bag will not be filled at the bag filling station 19. These sensors 58 may be electrical sensors but preferably are pneumatic sensors to avoid any contacts which might arc and thus this bag machine 11 is safe in dusty or explosive atmospheres. The motion of the hands 35 in the first path is by moving the forepart of the arms at the elbow pivots 51. The upward movement of the arms 34 is by pivoting at the shoulder pivots 52. In FIG. 1 the bag 25D is shown in the bag opening station 18 with the gripper hands having moved inwardly and upwardly so that the opening of the bag is opened and the clam-shell jaws 55 and 56 are opened and within the opening of the bag.

Figure 3:
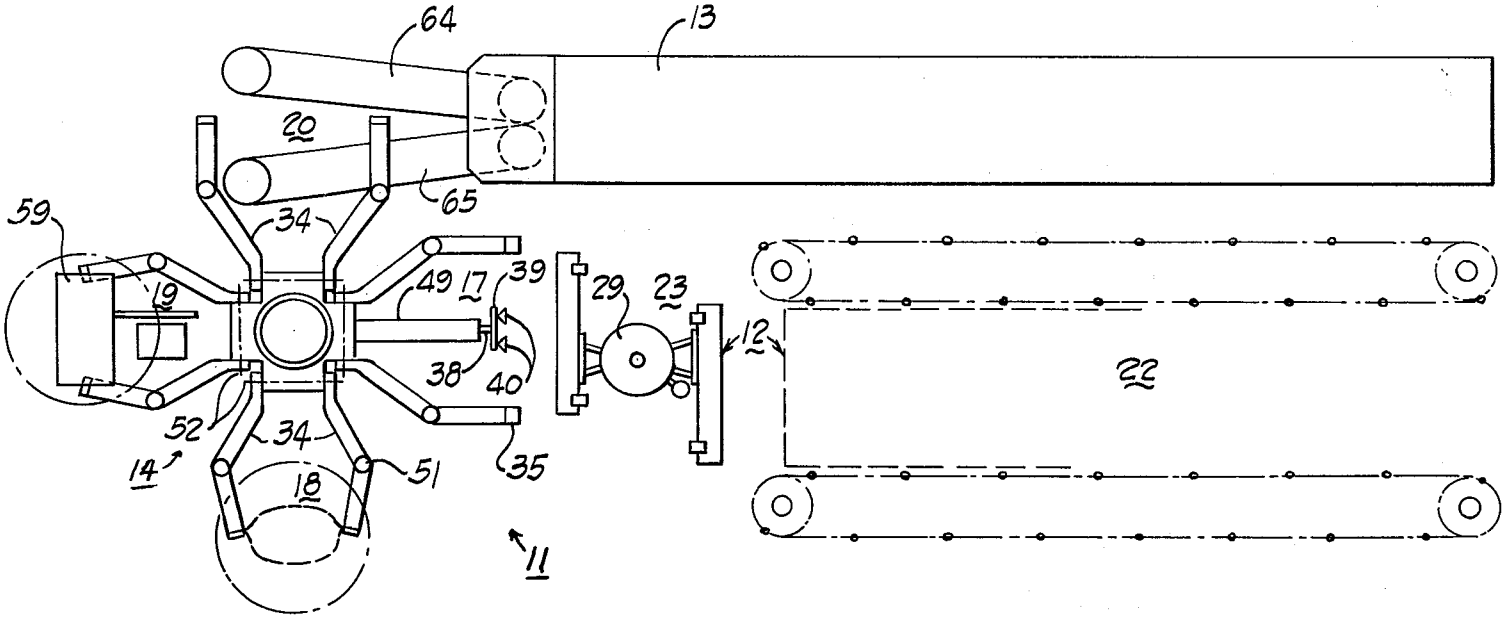
FIG. 3 is a plan view of the bag machine of the invention.

Next, the motor 50 indexes the frame 33 another 90° so that the properly opened and positioned bag will move to the bag-filling station 19 shown at the 9 o'clock position of FIG. 3.

Figure 2:
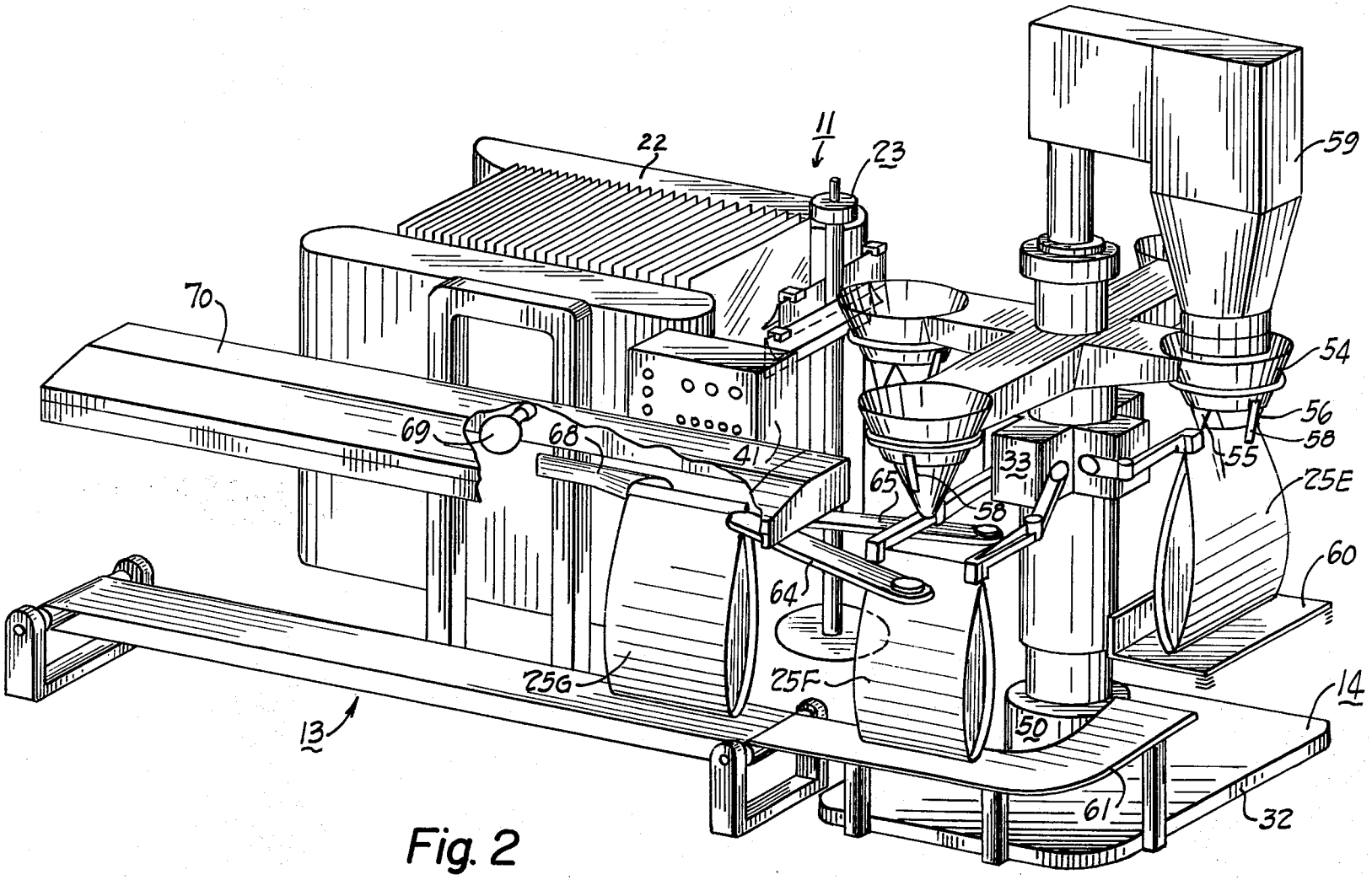
FIG. 2 is a perspective view of the rear of the machine of FIG. 1.

FIGS. 2 and 3 show the opened bag at the bag-filling station 19. A hopper 59 is mounted on the base 32 by suitable means, and material from the hopper 59 is transmitted via the spout 54 to the opened bag 25E in the bag-filling station 19. A vibrating platform 60 is provided at the bag-filling station to help the settling and filling of the bag 25E, as controlled by the control circuit 41.

Next, the motor 50 indexes the frame 33 so that the filled bag is moved from the 9 o'clock to the 12 o'clock position of FIG. 3, namely, to the bag-discharge station. FIG. 2 shows a bag 25F at this bag-discharge station. During this indexing motion the gripper hands 35 move apart in the first path from the second position to the first position and the hands also move downwardly by means of the arms 34 moving downwardly on the shoulder pivots 52. This moves the filled bag to a generally closed position, and the bottom of the bag may rest on or nearly rest on a curved conveyor, or, as shown, a curved platform 61.

At the bag-discharge station 19, conveyor belt gripper arms 64 and 65 have a scissors movement. They are shown in the open position in FIG. 2 but they next are closed in a scissors movement to grip near the top of the bag 25F just below the gripper hands 35. The leftward feeding movement of the inner run of these conveyor belt gripper arms 64 and 65 will grip and convey the filled bag to the left as shown in FIG. 2. As this leftward feed movement starts, the control circuit 41 opens the gripper hands 35 so that the controlled movement of the bag 25F is changed from the movement as effected by the motor 50 to a movement as effected by the gripper arms 64 and 65.

The bag closer 13 is shown in FIG. 2, and as the conveyor belt gripper arms 64 and 65 move the bag to the left as shown in this figure, the bag comes to a position 25G whereat the top edge of the bag enters a fold-over mechanism 68 shown as a curved shield to fold over the upstanding and longer rear side of the bag. This rear side of the bag may have heat activated adhesive on the top of the inner surface. Heaters 69 are disposed inside a hood 70 to activate the adhesive so that the bag is sealed as it is conveyed by the conveyor belt arms 64 and 65.

It will be noticed that the bag machine 11 of the present invention moves the bag from the bag holder 12 through the multi-station bag filler 14 to the bag closer 13. Bags are properly aligned or oriented and vertically positioned in the aligner-feeder portion 23 of the bag holder 12. If the bags are not properly aligned, they are rejected. The multi-station bag filler 14 rapidly performs the many sequences of properly opening the bag, raising it upwardly onto the openable spout jaws 55 and 56, and this is accomplished preferably during indexing to the bag opening station 18. Also, this multi-station bag filler 14 rapidly moves the opened bags to the bag filling station 19 whereat material from the hopper 59 is used to fill the bags via the spout 54. Also, the properly filled bags are moved to the bag-discharge station 20 whereat they are delivered to the bag closer and sealer 13. Properly orientated bags are moved by the transfer arm 38 from the bag holder 12 to the bag pickup station, and as soon as the motor 50 indexes the frame 33 of the bag filler 14 about 30°, this transfer arm 38 is available to move forwardly to obtain another bag from the aligner-feeder 23. This materially speeds up the process of orientating, opening, and filling the bags compared to the known prior art machines.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A bag machine, comprising, in combination:
a bag holder;
a bag closer; and
a multi-station bag filler supplying filled bags to said bag closer;
said multi-station bag filler including a base,
a frame journalled for rotation on said base about an axis;
arm means on said frame,
a pair of gripper hands on said arm means,
motor means connected between said base and said frame to index said frame around said axis between at least a bag pickup station and a bag filling station,
transfer means connected to transfer bags from said bag holder to said gripper hands when said hands are at said bag pickup station,
said transfer means including a transfer arm mounted for movement relative to said base and substantially normal to the plane of the bag to transfer bags from said holder to said gripper hands,
said hands being actuable between open and closed positions with said closed position gripping two portions of the bag with the bag carried in said transfer means,
means to allow said gripper hands to move in a first path toward each other from a first to a second position to open the top of the bag,
and means at said bag filling station to fill a bag held in said gripper hands.

2. A bag machine as set forth in claim 1, wherein said arm means includes a pair of gripper arms, and one each of said gripper hands being mounted on a gripper arm.

3. A bag machine as set forth in claim 1, wherein said hands clamp face-to-face over the two top corners of the bag adjacent a top opening of the bag.

4. A bag machine as set forth in claim 1, wherein said bag holder includes a bag magazine to hold a plurality of bags.

5. A bag machine as set forth in claim 4, wherein said bag holder includes an aligner-feeder connected to align bags sequentially received from said magazine and feed the bags to said pickup station.

6. A bag machine as set forth in claim 5, wherein said aligner-feeder includes means to locate the top end of the bag to be gripped in said located condition by said gripper hands.

7. A bag machine as set forth in claim 5, wherein said transfer arm is mounted for movement generally radially of said frame to transfer a bag in a rectilinear movement to a tangential position held by said gripper hands at said bag pickup station.

8. A bag machine as set forth in claim 7, including means to locate the position of the top edge of the bag to be gripped by said gripper hands at said bag pickup station.

9. A bag machine as set forth in claim 1, including a first motor connected to move said transfer arm between advanced and retracted positions relative to said base,
and means on said transfer arm to receive and support a bag from said bag holder when said transfer arm is in the advanced position.

10. A bag machine as set forth in claim 9, wherein said means to receive and support a bag on said transfer arm includes at least one suction cup mounted on said arm,
and means to apply and release the suction of said at least one suction cup to effect support of a bag by said gripper hands upon release of suction and with said transfer arm at said retracted position.

11. A bag machine as set forth in claim 1, wherein said multi-station bag filler includes a bag opening station to open said bag preparatory to filling at said bag filling station.

12. A bag machine as set forth in claim 11, wherein said bag filler includes a bag discharge station to discharge a filled bag to said closer,
and said motor means connected between said base and said frame indexes said frame around said axis in 90° increments between adjacent ones of the four different stations.

13. A bag machine as set forth in claim 11, wherein said bag filling means includes an openable spout on said base at said bag opening station,
and said hands being movable upwardly to cooperate with said openable spout in penetrating between the front and rear faces of the bag to open the opening of the bag.

14. A bag machine as set forth in claim 13, wherein said bag filling means includes a hopper on said base at said bag filling station to fill via said spout a bag at said filling station.

15. A bag machine, comprising, in combination,
a bag closer and sealer;
a multi-station bag filler supplying filled bags to said bag closer and sealer;
a bag holder including a magazine to hold a plurality of bags in horizontally stacked, face-to-face relationship, and an aligner-feeder connected to align bags sequentially received from said magazine and feed the bags to said filler;
said multi-station bag filler including a base,
a frame journalled for rotation on said base about a vertical axis,
a transfer arm mounted for movement relative to said base, a first motor connected to move said transfer arm between advanced and retracted positions relative to said base, at least one suction cup mounted on said arm to receive and support a bag from said aligner-feeder when in the advanced position, a pair of gripper arms movable through a generally vertical path, a hand on each gripper arm, said gripper hands being movable in a first path between first and second positions, said hands being actuable between open and closed positions with said closed position clamping face-to-face over the top corners of the bag with the bag in the retracted position of the transfer arm and with the bag gripper arms in a lower position on said generally vertical path, means to apply and release the suction of said at least one suction cup to effect support of a bag by said hands upon release of suction, a motor connected between said base and said frame to index said frame around said vertical axis in 90° increments among a bag pickup station, a bag opening station, a bag filling station and a bag discharge station to said closer and sealer, an openable spout on said base at said bag opening station, said gripper arms and hands being movable upwardly while said hands are gripping a bag at said bag opening station to cooperate with said openable spout in penetrating between the front and rear faces of the bag to open the top of the bag, a hopper on said base at said bag filling station, means at said bag filling station to fill from said hopper via said spout a bag at said bag filling station held in said gripper arm hands, and means at said discharge station to effect release of said filled bag by said gripper arm hands to transfer said filled bag to said closer and sealer.

* * * * *